US005102482A

United States Patent [19]

Rogers, Jr.

[11] Patent Number: 5,102,482

[45] Date of Patent: Apr. 7, 1992

[54] METHOD FOR MAKING A WATER PERMEABLE LAMINATED, TEXTILE FABRIC PRODUCT

[76] Inventor: James H. Rogers, Jr., 1921 Fairington Rd., Dalton, Ga. 30720

[21] Appl. No.: 353,795

[22] Filed: May 18, 1989

[51] Int. Cl.[5] ..... B32B 3/02; D05C 17/02

[52] U.S. Cl. ..... 156/72; 156/252; 156/324; 156/497; 428/92; 428/97

[58] Field of Search ..... 156/72, 82, 252, 253, 156/497, 324; 428/9, 97

[56] References Cited

U.S. PATENT DOCUMENTS

| | | | |
|---|---|---|---|
| 3,922,454 | 11/1975 | Roecker | 156/72 |
| 4,007,307 | 2/1977 | Friedrich | 428/319.7 |
| 4,061,804 | 12/1977 | McCulloch | 428/17 |
| 4,268,551 | 5/1981 | Moore, Jr. | 156/72 |
| 4,497,853 | 2/1985 | Tomarin | 428/95 |
| 4,505,960 | 3/1985 | Leffingwell | 428/95 |
| 4,508,771 | 4/1985 | Peoples, Jr. et al. | 156/72 |
| 4,512,831 | 4/1985 | Tillotson | 428/95 |
| 4,515,839 | 5/1985 | Broaddus et al. | 428/95 |
| 4,581,269 | 4/1986 | Tilman | 428/100 |
| 4,617,218 | 10/1986 | Cadenhead, Sr. | 428/17 |
| 4,662,778 | 5/1987 | Dempsey | 428/95 |
| 4,738,407 | 4/1988 | Arrant | 273/27 |
| 4,849,267 | 7/1989 | Ward et al. | 428/95 |
| 4,902,540 | 2/1990 | Martino | 428/17 |

FOREIGN PATENT DOCUMENTS

| | | | |
|---|---|---|---|
| 2704335 | 8/1977 | Fed. Rep. of Germany | 428/95 |

*Primary Examiner*—Virginia Manoharan
*Attorney, Agent, or Firm*—Needle & Rosenberg

[57] ABSTRACT

A method of producing a water permeable, laminated textile product having the steps of applying an adhesive coating to the rear surface of the textile fabric having a front and rear surface, passing a fluid into a portion of the front surface to form a pluality of openings through the adhesive and the textile fabric and adhering a water permeable backing to the textile fabric.

8 Claims, 2 Drawing Sheets

METHOD FOR MAKING A WATER PERMEABLE LAMINATED, TEXTILE FABRIC PRODUCT

BACKGROUND OF THE INVENTION

The present invention relates to the textile industry, and more particularly to a water permeable, laminated textile product, such as artificial turf.

The use of artificial turf as an outdoor playing surface is known. One disadvantage of artificial turf, and of all textile fabrics in general, is that they have an inadequate amount of dimensional stability. Knitted products in particular have poor dimensional stability because of the large amount of space between individual fibers. The lack of stability causes the textile products to either stretch, pucker, wrinkle or generally lose shape when under stress. For example, large expanses of artificial turf are subject to extreme amounts of deformity due to exposure to harsh climatic conditions, as well as to the physical punishment experienced during athletic events.

The most preferred method of accomplishing dimensional stability in a textile product is laminating a scrim onto the rear surface of the textile fabric. This typically requires placing a coating of adhesive across the entire fabric rear surface. A problem exists, however, in that the adhesive tends to harden in the spaces between the fibers of the textile fabric, thereby creating a water barrier. As a result, the textile product becomes impermeable to water. This problem is of particular importance in the case of artificial turf because rain water and other liquids become trapped on and within the turf surface and interfere with events. To overcome this problem, holes have been punched through the textile product. This, however, results in diminished dimensional stability.

Therefore, there exists a need for a textile product which includes a scrim backing and which is water permeable.

SUMMARY OF THE PRESENT INVENTION

The present invention relates to a method and apparatus for producing a water permeable, laminated textile product, such as artificial turf. According to the method, an adhesive coating is applied to the rear surface of a textile fabric. A pressurized fluid, such as air, is passed through the front surface of the textile fabric to form a plurality of openings through the adhesive and the fabric. This will act to remove adhesive from the space between fibers of the fabric while leaving the adhesive on the fibers themselves. A water permeable scrim backing is then adhered to the textile fabric to form the laminated textile product.

The present method produces a textile product which has a plurality of openings through the textile fabric leading to the water permeable scrim, thereby making the entire product water permeable. This is particularly useful when the product is an artificial turf, such as that used on a playing field, because the turf will have both dimensional stability and water permeability.

Therefore, it is an object of the present invention to provide a textile product which includes a scrim backing for stability and which is water permeable.

DETAILED DESCRIPTION OF THE PREFERRED EMBODIMENT

The present invention relates to a method and apparatus for producing a water permeable textile product having a secondary backing, such as a scrim. The process for manufacturing the product includes three primary steps. An adhesive coating is applied to the rear surface of a web of textile fabric, preferably knitted, having a front surface and a rear surface and which is moving along a certain path of travel. A fluid, such as compressed air, is then blown or otherwise passed through the front surface of the fabric to remove adhesive from the spaces between the fabric fibers while leaving adhesive on the fibers themselves. Then, downstream from the fluid, a water permeable scrim backing is mated to the rear surface of the textile fabric. The laminate of the fabric with the scrim thereon is then cured to form the finished product. The backing may be woven, knit, nylon mesh, or any other material capable of providing dimensional stability to the overlying fabric. Also, the backing may be a water permeable shock-absorbing pad.

Many types of adhesive, such as polyurethane, natural latex or carboxylated latex, may be used in the present invention. However, polyurethane is preferred since it will withstand ultraviolet rays, moisture, heat, cold and other inclement weather conditions. Preferably, the adhesive weight should be in the range from about 24 ounces per square yard to about 40 ounces per square yard, depending on the fabric being coated. Furthermore, the adhesive should be sufficiently viscous to ride on top of the fibers without "wicking into" or otherwise clogging the spaces between the fibers. This viscosity may be achieved by adding thickener and/or injecting air bubbles into the adhesive. The injection of air bubbles provides the additional advantage of adding bulk and weight control to the adhesive.

Figure 2:
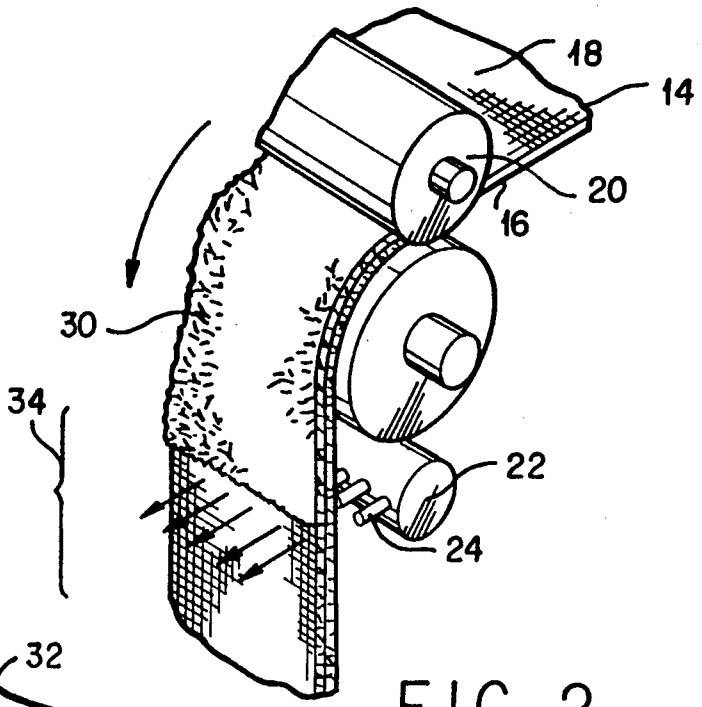
FIG. 2 is a perspective view of an apparatus and textile fabric product according to the present invention.
Figure 1:
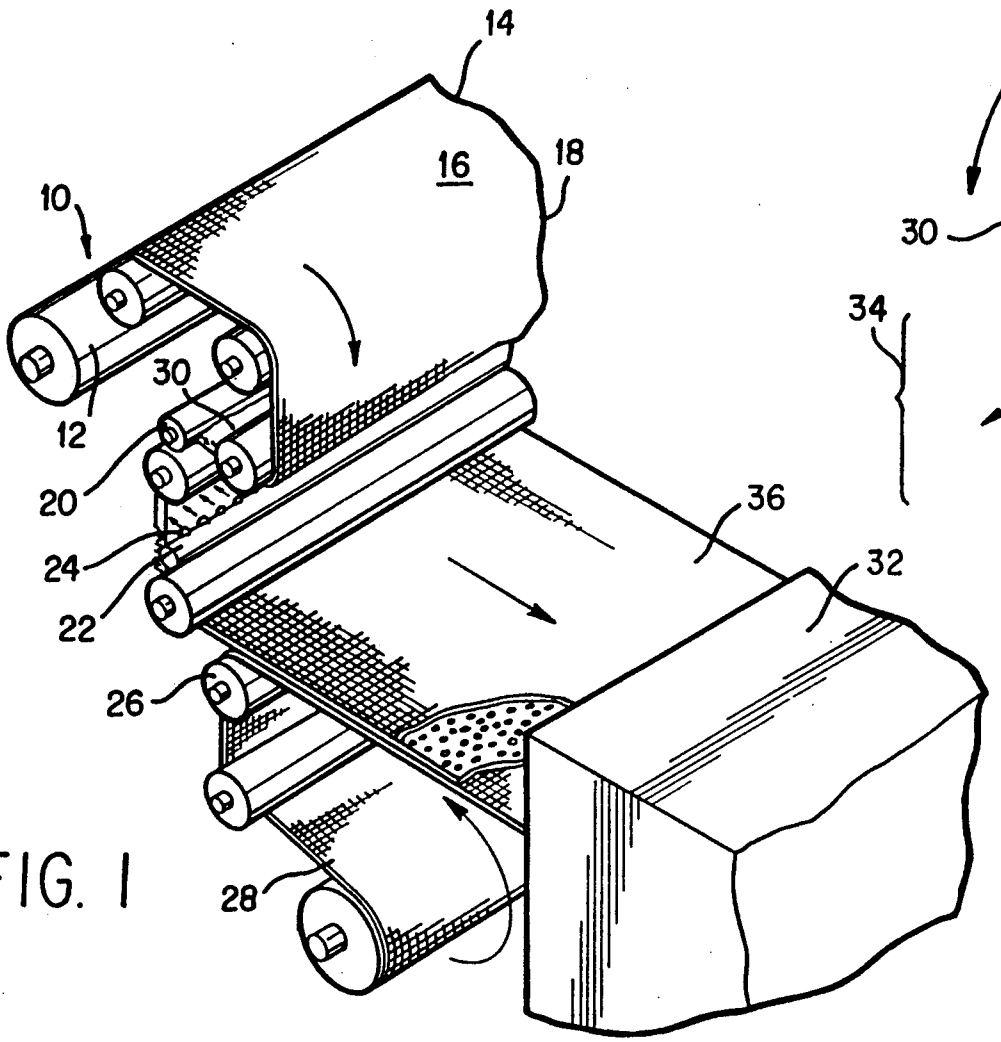
FIG. 1 illustrates an apparatus according to the present invention.

FIGS. 1 and 2 illustrate one embodiment of an apparatus 10 according to the present invention. The apparatus 10 preferably includes means, such as a standard roller type device 12, for moving along a certain path of travel a web of textile fabric 14 having a front 16 and rear 18 surface. Also provided are means along the path for applying an adhesive coating to the rear surface 18 of the fabric 14. For example, the adhesive may be metered from a standard rolling puddle type adhesive application device 20. Means for passing a pressurized fluid into a portion of the fabric front surface 16 are provided along the path of the travel downstream from the adhesive applying means. The fluid passing means may be an air manifold 22 having one or more air jets 24 laterally extending across the path of travel of the fabric 14 and directed at the front surface 16. Means, such as a standard roller-type device 26, for adhering a water permeable backing to the rear surface 18 of the textile fabric 14 are provided along the path downstream of the fluid passing means.

In operation, the rear side 18 of a continuous roll or web of textile fabric 14 is coated with an adhesive 30 as described above. The fabric 14 is then passed in front of the air manifold 22 containing a plurality of evenly spaced air jets 24 expelling compressed air through the front surface 16 of the fabric 14. The adhesive 30, which had been coated to the rear surface 18 of the fabric 14, is consequently blown out of the spaces between the fibers of the fabric 14 in those areas in line with the air jets 24. After the fabric 14 passes in front of the manifold 22, a water permeable secondary backing 28 is supplied from a second roll and mated or otherwise adhered to the rear surface 18 by means of the adhesive 30 remaining on the fibers themselves. Once the fabric 14 and backing 28 are adhered, the resulting laminate 36 preferably thereafter enters a curing oven 32 to create the final textile product 38, illustrated in FIG. 4. The curing should be performed after the air is applied in order to remove the adhesive 30 from the spaces before the adhesive 30 solidifies.

The manifold 22 preferably stretches the full width of the fabric 14 and is adjustable to accommodate different widths of fabric 14. Air jets 24 are preferably evenly spaced across the width of the manifold 22 and have narrow openings, such as approximately ¼ inch in diameter. The number of air jets 24 along the manifold 22 should be selected to provide a proper amount of air flow through the fabric 14 to (1) remove enough adhesive 30 between the fabric fibers to allow adequate permeability in the final textile product 38 but still retain enough adhesive on the fabric fibers themselves to insure a dependable bond between the textile fabric 14 and the secondary backing 28. The air pressure used by the manifold 22 should be low enough to prevent disturbing the textile fibers, while great enough to remove the adhesive 30. Thus, the heavier the adhesive 30 the greater the pressure need be to remove it from the spaces. To achieve this, a pressure regulator between the source of pressurized air (not shown) and the manifold 22 may be used. Also, a curtain 34 or other collecting means may be erected behind the rear surface 18 of the textile fabric 14 to collect any adhesive 30 that splatters due to the air being applied to the fabric 14.

Figure 4:
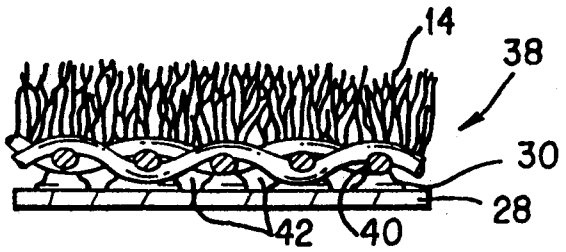
FIG. 4 is a cross-sectional view of a textile product according to the present invention.
Figure 3:
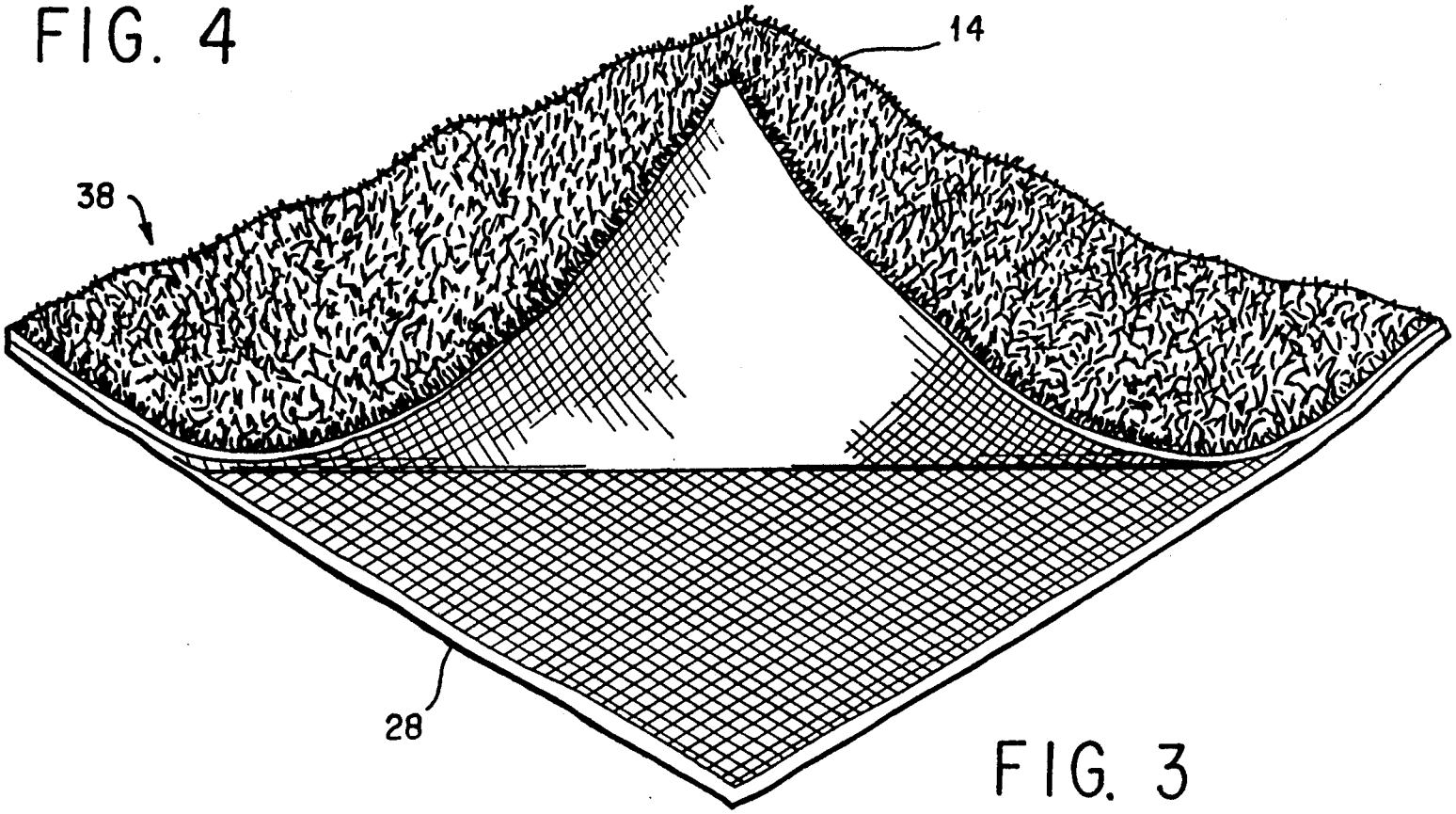
FIG. 3 is a perspective view of a textile product of the present invention having its textile fabric layer and scrim layer separated to show the adhesive.

As a result of the above method, the textile product 38, shown in FIGS. 3 and 4, will have adhesive 30 bonding the fibers 40 of the textile fabric 14 to the backing 28 or scrim, and open spaces 42 through its fabric 14 leading to the water permeable secondary backing 28. The product 38 will be water permeable and suitable for use as an artificial turf or any other application in which both dimensional stability and drainage of water is desired.

What is claimed is:

1. A method of producing a water permeable, laminated textile product comprising the steps of:

a) applying an adhesive coating to the rear surface of a textile having a front and rear surface;

b) passing a pressurized air into a portion of said front surface to form a plurality of spaces through said adhesive and said textile fabric wherein said passing step comprises the step of moving the textile fabric over a fluid source which comprises a plurality of pressurized air jets which laterally extend across the path of travel of said textile fabric; and c) adhering a water permeable backing to said textile fabric.

2. The method of claim 1, wherein said water permeable backing is a scrim.

3. The method of claim 1, wherein said water permeable backing is a shock-absorbing pad.

4. The method of claim 1, and further comprising the step of collecting the adhesive coating forced off said textile fabric by said pressurized air.

5. The method of claim 1, wherein said textile product is artificial turf.

6. The method of claim 1, wherein said adhesive coating is polyurethane.

7. The method of claim 1, wherein said adhesive coating is thickened prior to being applied to said textile fabric.

8. The method of claim 1, and further comprising the step of curing said textile product.

* * * * *